US008647178B2

(12) United States Patent
Min et al.

(10) Patent No.: US 8,647,178 B2
(45) Date of Patent: Feb. 11, 2014

(54) POLISHING PAD OF POLISHING SYSTEM

(71) Applicant: LG Chem, Ltd., Seoul (KR)

(72) Inventors: Kyoung-Hoon Min, Daejeon (KR); Ye-Hoon Im, Daejeon (KR); Dae-Yeon Lee, Chungbuk (KR); Jae-Ik Song, Gyeonggi-do (KR); Su-Chan Park, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 13/769,029

(22) Filed: Feb. 15, 2013

(65) Prior Publication Data

US 2013/0196580 A1 Aug. 1, 2013

Related U.S. Application Data

(63) Continuation of application No. PCT/KR2011/006088, filed on Aug. 18, 2011.

(30) Foreign Application Priority Data

Aug. 18, 2010 (KR) ..... 10-2010-0079882

(51) Int. Cl.
*B24D 11/00* (2006.01)

(52) U.S. Cl.
USPC ..... 451/488; 451/527

(58) Field of Classification Search
USPC ..... 451/526, 527, 533, 534, 446, 488, 287
See application file for complete search history.

(56) References Cited

U.S. PATENT DOCUMENTS

| | | | | |
|---|---|---|---|---|
| 6,120,366 | A * | 9/2000 | Lin et al. | 451/550 |
| 6,955,587 | B2 * | 10/2005 | Muldowney | 451/41 |
| 7,131,895 | B2 * | 11/2006 | Elmufdi et al. | 451/103 |
| 7,311,590 | B1 | 12/2007 | Muldowney | |
| 7,329,174 | B2 * | 2/2008 | Hosaka et al. | 451/527 |
| 7,357,703 | B2 * | 4/2008 | Nishimura et al. | 451/527 |
| 2008/0090503 | A1 * | 4/2008 | Park et al. | 451/287 |

FOREIGN PATENT DOCUMENTS

| | | |
|---|---|---|
| JP | 2003-145402 | 5/2003 |
| JP | 2004-327567 | 11/2004 |
| KR | 10-2001-0038440 | 5/2001 |
| KR | 10-0568258 | 4/2006 |
| KR | 10-2008-0071933 | 8/2008 |

* cited by examiner

*Primary Examiner* — Robert Rose
(74) *Attorney, Agent, or Firm* — McKenna Long & Aldridge, LLP

(57) ABSTRACT

A polishing pad of a polishing system is mountable to a polishing plate and has a predetermined channel pattern so as to allow a polishing liquid supplied from a polishing liquid supplier to move on a polishing surface. The channel pattern has at least two kinds of patterns.

10 Claims, 6 Drawing Sheets

POLISHING PAD OF POLISHING SYSTEM

CROSS-REFERENCE TO RELATED APPLICATION

The present application is a continuation of International Application No. PCT/KR2011/006088 filed on Aug. 18, 2011, which claims priority to Korean Patent Application No. 10-2010-0079882 filed in the Republic of Korea on Aug. 18, 2010, the disclosures of which are incorporated herein by reference.

TECHNICAL FIELD

The present disclosure relates to a polishing pad, and more particularly, to a polishing pad of a polishing system for polishing a sheet glass used for a liquid crystal display.

BACKGROUND ART

Generally, it is very important for a sheet glass (or, a glass pane) applied to a liquid crystal display to maintain its flatness to a certain level in order to accurately realize an image. The sheet glass is prepared by a fusion method or a float method. Most existing sheet glasses (about 95% or more) are prepared by the float method. A glass produced by the float method (or, a float glass) is processed into a ribbon shape in a float bath and then cut into a predetermined size during a cutting process. In addition, a polishing process for removing fine unevenness or impurities present at the surface of the float glasses is performed.

Meanwhile, the polishing process of a glass substrate may be classified into a so-called 'Oscar' method where individual glass substrates are polished one by one and a so-called 'inline' method where a series of glass substrates are polished successively. In addition, the conventional polishing process may also be classified into a 'single surface polishing' where only one surface of a glass substrate is polished and a 'both surface polishing' where both surfaces of a glass substrate are polished.

The conventional sheet glass polishing device polishes a sheet glass by using a polishing liquid supplied onto the polishing plate while rotating a lower unit, in a state where the sheet glass is located on the lower unit (or, the lower plate) and a polishing pad of the polishing plate (or, an upper plate) is in contact with the sheet glass. The polishing pad for polishing the sheet glass in contact with a surface of the sheet glass to be polished is attached to the polishing plate of the sheet glass polishing device.

FIG. 1 is a plane view schematically showing a conventional polishing pad.

Referring to FIG. 1, a conventional polishing pad 1 has an overall disk shape and includes a central supply hole 2 prepared at the center thereof and six radial supply holes 3 arranged radially at a predetermined radius. The supply holes 2 and 3 are used for receiving a polishing liquid from the outside toward a polishing surface of the polishing pad 1. Meanwhile, a channel for regularly dispersing a polishing liquid, supplied from the polishing liquid supply holes 2 and 3, to the entire polishing surface is provided at the polishing surface of the polishing pad 1. This channel has a channel pattern with a straight form (a rectangular lattice).

However, since the polishing pad 1 rotates (in the clockwise direction or in the counterclockwise direction) in contact with a sheet glass (not shown), the polishing liquid flowing through the channel formed at the polishing surface of the polishing pad 1 is influenced by a centrifugal force. Therefore, in the conventional polishing pad 1, the rotating direction of the polishing pad 1 is not in agreement with the direction of the straight lattice-type channel pattern of the polishing surface. This causes a flux difference or irregular flow of the polishing liquid which flows through the channel formed at the polishing pad 1. Meanwhile, in case of the polishing pad 1 having such a channel pattern, if a polishing rate is high or an amount of supplied polishing liquid is great, a hydroplaning phenomenon may occur during the polishing process.

FIG. 2 is a graph showing a measured speed distribution of a polishing liquid which flows through the channel of the conventional polishing pad of FIG. 1. Here, the X axis of the graph represents an arbitrary location of the polishing pad 1, which means a direction expressed by the Roman alphabet, and the Y axis represents a flow rate ($kg/m^2s$) of the polishing liquid.

Referring to FIG. 2, a speed deviation of the polishing liquid generated from the entire polishing surface of the polishing pad 1 is 0.6 m/s, which is very great. In other words, the flux difference of the polishing liquid is remarkable near the edge of the polishing pad 1.

DISCLOSURE

Technical Problem

The present disclosure is designed to solve the problems of the prior art, and therefore it is an object of the present disclosure to provide a polishing pad of a polishing system with an improved structure, which may uniformly distribute a polishing liquid over the entire polishing surface by optimizing a channel pattern formed at the polishing pad.

Technical Solution

In one aspect, the present disclosure provides a polishing pad of a polishing system, which is mountable to a polishing plate and has a predetermined channel pattern so as to allow a polishing liquid supplied from a polishing liquid supplier to move on a polishing surface, wherein the channel pattern has at least two kinds of patterns.

In a preferred embodiment, the polishing pattern may include: a first channel pattern formed in a first region containing the center of the polishing pad; and a second channel pattern formed in a second region divided to surround the first region from the center toward the outside.

The first channel pattern may be a conventional straight lattice pattern or not. However, since the second channel pattern is more influenced by a centrifugal force of the polishing pad, the second channel pattern is preferably configured with a non-straight form (for example, a radial form, a curved form, a secondary curve or the like), and its direction may be identical to or opposite to the rotating direction of the polishing pad, as understood by those skilled in the art.

In a preferred embodiment, the second channel pattern may include: at least two circular channels concentrically arranged from the center and spaced apart from each other by a predetermined interval; and a plurality of radial channels arranged extending radially from the center to intersect the circular channels.

In a preferred embodiment, each radial channel may be provided to be in agreement with a centrifugal direction of the polishing pad.

In a preferred embodiment, each radial channel is preferably disposed in a straight form, but as an alternative, the radial channels may have a non-straight form in order to give an effect corresponding to the centrifugal force of the polishing pad, as apparent to those skilled in the art.

In a preferred embodiment, the second region may include an inner region disposed adjacent to the first region and an outer region disposed at an outer side of the inner region, and, in the second channel pattern, channels of the outer region may be disposed more densely than channels of the inner region.

In an alternative embodiment, channels of the inner region may be disposed more densely than channels of the outer region.

In a preferred embodiment, the second channel pattern may further include a second radial channel formed between neighboring radial channels in the outer region. The second radial channel is used to arrange the channels more densely and may be configured with a curved shape, without being a straight shape, as apparent to those skilled in the art.

In a preferred embodiment, the polishing liquid supplier may include: a first supplier for supplying the polishing liquid to the first region; and a second supplier for supplying the polishing liquid to the second region.

Preferably, the first supplier may include: a first hole formed through the first supplier to be in agreement with the center; and a straight supply path disposed across the first region to communicate with the first hole and the second supplier.

In a preferred embodiment, the second supplier may include: a plurality of second holes formed through the second supplier on a border line of the first region and the second region; a circular supply path provided on the border line to communicate with the second holes; and a curved radial supply path formed to curve outwards with a radial shape from each second hole.

In a preferred embodiment, the polishing pad may be circular. The polishing pad preferably has a disk shape whose diameter is about 200 mm.

In a preferred embodiment, the first channel pattern may include a plurality of lattice-type channels substantially orthogonal to each other.

In a preferred embodiment, the channel may have a width of about 1 to 30 mm, and an interval between neighboring channels may be about 10 to 100 mm.

In a preferred embodiment, the polishing pad is used for polishing a float glass prepared by means of a float method. However, the polishing pad may also be applied to a sheet glass prepared by means of a fusion method or other parts which need precise polishing to maintain predetermined flatness, as apparent to those skilled in the art.

Advantageous Effects

The polishing pad of a polishing system according to the present disclosure may minimize a flux difference or deviation of a polishing liquid flowing through channels of a polishing surface by forming so-called radial channels having a radial pattern in a direction substantially in agreement with the direction of a centrifugal force caused by the rotation of the polishing pad based on the center of the polishing surface. Therefore, during the polishing process of the polishing system, polishing uniformity and wide process range may be ensured.

Meanwhile, if the radial channel pattern is formed, even though a polishing speed of the polishing system relatively decreases or an amount of supplied polishing liquid is reduced, an unnecessary hydroplaning phenomenon may be prevented.

DESCRIPTION OF DRAWINGS

Other objects and aspects of the present disclosure will become apparent from the following descriptions of the embodiments with reference to the accompanying drawings. The drawings illustrate a fluid supplying apparatus and a thin film cleaning system and method according to exemplary embodiments. However, it should be understood that the disclosure is not limited to components or means depicted in the drawings. In the drawings.

REFERENCE SYMBOL

Figure 1:
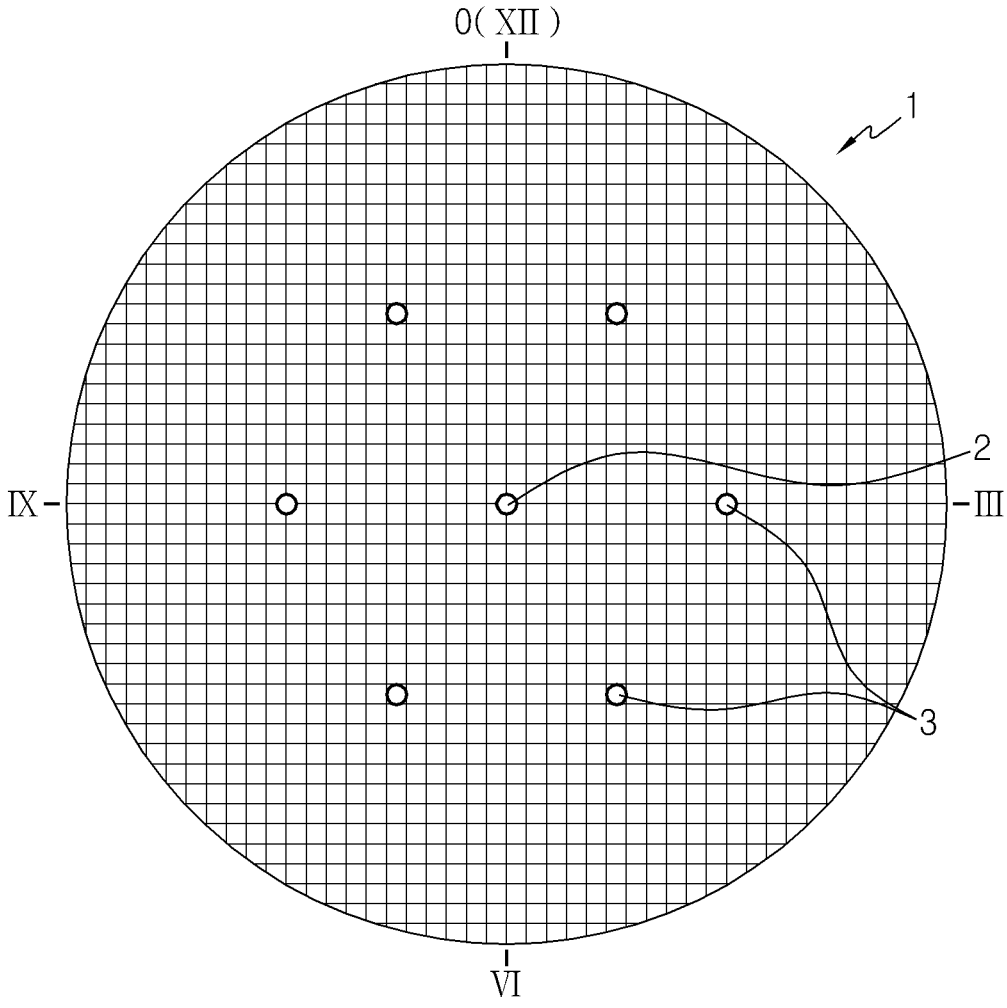
FIG. 1 is a plane view schematically showing a conventional polishing pad.
Figure 2:
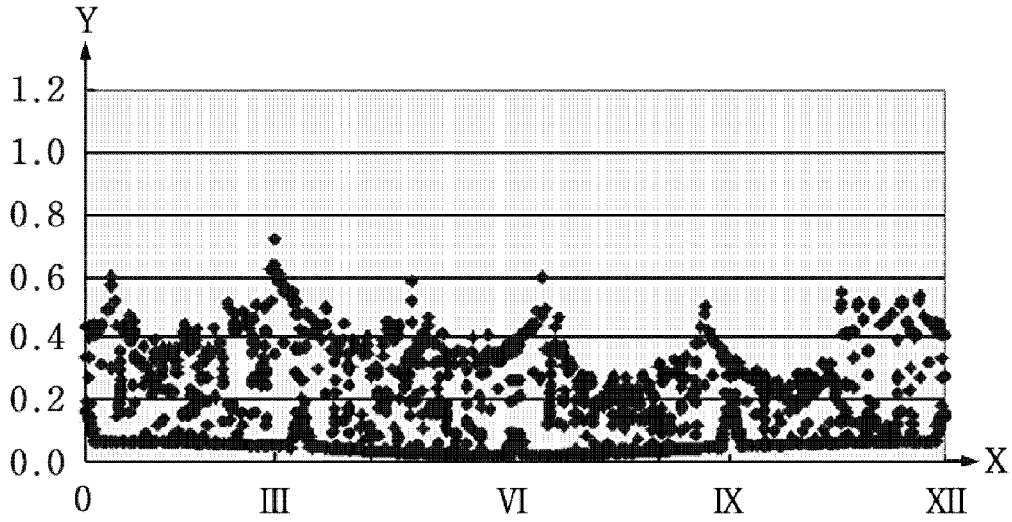
FIG. 2 is a graph showing a measured speed distribution of a polishing liquid which flows through a channel of the conventional polishing pad of FIG. 1.

| | |
|---|---|
| 100: sheet glass polishing system | 110: lower unit |
| 114: rotary shaft | 120: upper unit |
| 124: spindle | 130: polishing liquid supply unit |
| 140: carrier | 200: polishing pad |
| 201: channel | 202: polishing surface |
| 204: first region | 205: inner region |
| 206: second region | 207: outer region |
| 210: polishing liquid supplier | 212: first supplier |
| 213: first hole | 214: second supplier |
| 215: second hole | 217: circular supplier |
| 219: radial supply path | 220: first channel pattern |
| 230: second channel pattern | 232: circular channel |
| 234: radial channel | 236: second radial channel |

BEST MODE

Terms used in the following detailed description are for convenience and not for limiting the disclosure. Terms such as "right", "left", "top surface", and "bottom surface" represent a respective direction in the drawing that it refers to. Terms such as "inward" and "outward" respectively represent a direction oriented to or departing from a geometric center of a respective designated apparatus, system, or member. Terms such as "front", "rear", "upper", "lower" and its relevant words or phrases represent locations and orientations in the drawing that it refers to, and they are not intended to limit the disclosure. These terms include words listed above, their derivatives and their synonyms.

Exemplary embodiments will be described with reference to the accompanying drawings.

Figure 3:
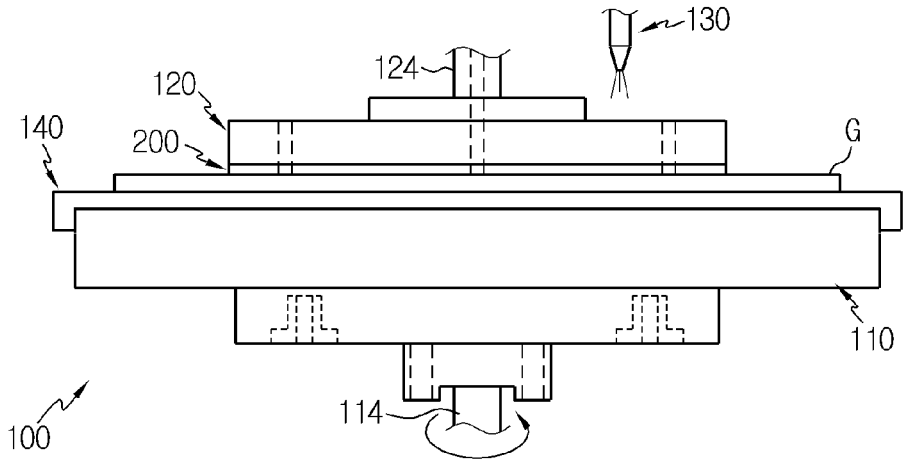
FIG. 3 is a schematic view showing a sheet glass polishing system to which a polishing pad according to a preferred embodiment of the present disclosure may be installed.

FIG. 3 is a schematic view showing a sheet glass polishing system to which a polishing pad according to a preferred embodiment of the present disclosure may be installed.

Referring to FIG. 3, a sheet glass polishing system 100 according to a preferred embodiment of the present disclosure is used for polishing a sheet glass so that the flatness of a large sheet glass G having, for example, a size over 1000 mm and a thickness of about 0.3 mm to 1.1 mm may be maintained to a level required for a liquid crystal display. In addition, the polishing system 100 includes, for example, a lower unit 110 having a turn table 112 capable of rotating a sheet glass G to be polished with a predetermined rotating number in a state where the sheet glass G is fixed; an upper unit 120 installed at the upper side of the lower unit 110 and movable in a horizontal direction and a vertical direction so that a polishing pad 200 contactable to the upper surface, namely a surface to be polished, of the sheet glass G supported by the lower unit 110 is attached thereto, and a polishing liquid supply unit 130 for supplying a polishing liquid between the polishing surface of the polishing pad 200 and a surface of the sheet glass G to be polished.

In the sheet glass polishing system 100 of this embodiment, a dimension of a rectangular sheet glass G to be polished (the smallest dimension between a length and a width) is greater than dimensions of the upper unit 120 and/or the polishing pad 200 attached thereto. In addition, a rotary shaft 114 of the lower unit 110 and a spindle of the upper unit 120 are not located on the same straight line but preferably relatively move in an offset state. In the sheet glass polishing system 100 of this embodiment, if the lower unit 110 rotates and simultaneously the upper unit 120 moves along a predetermined horizontal trajectory in a state where the polishing pad 200 is in contact with a surface of the sheet glass G to be polished, the entire surface of the sheet glass G to be polished is uniformly polished by, for example, a polishing liquid supplied from the polishing liquid supply unit 130 while the upper unit 120 is rotated by the rotation of the lower unit 110. Reference symbol 140 represents a carrier for supporting the sheet glass G to the lower unit 110.

According to another embodiment of the present disclosure, the upper unit 120 and the polishing liquid supply unit 130 may employ an upper unit and a polishing liquid supply unit disclosed in Korean Patent Application Nos. 10-2009-192290, 10-2009-192292 and 10-2009-192293, filed on Mar. 6, 2009 by the same applicant as this application and entitled 'a sheet glass polishing system', and an upper unit disclosed in Korean Patent Application No. 10-2010-0007100, filed on Jan. 19, 2010 by the same applicant as this application and entitled "a lower unit for a 'sheet glass polishing system and a polishing method using the same', as well understood by those skilled in the art.

In addition, the sheet glass G of this embodiment is prepared by means of a float method and refers to a so-called float glass obtained by cutting a ribbon-type glass, processed into predetermined thickness and width in a float bath, by a predetermined length.

Figure 4:
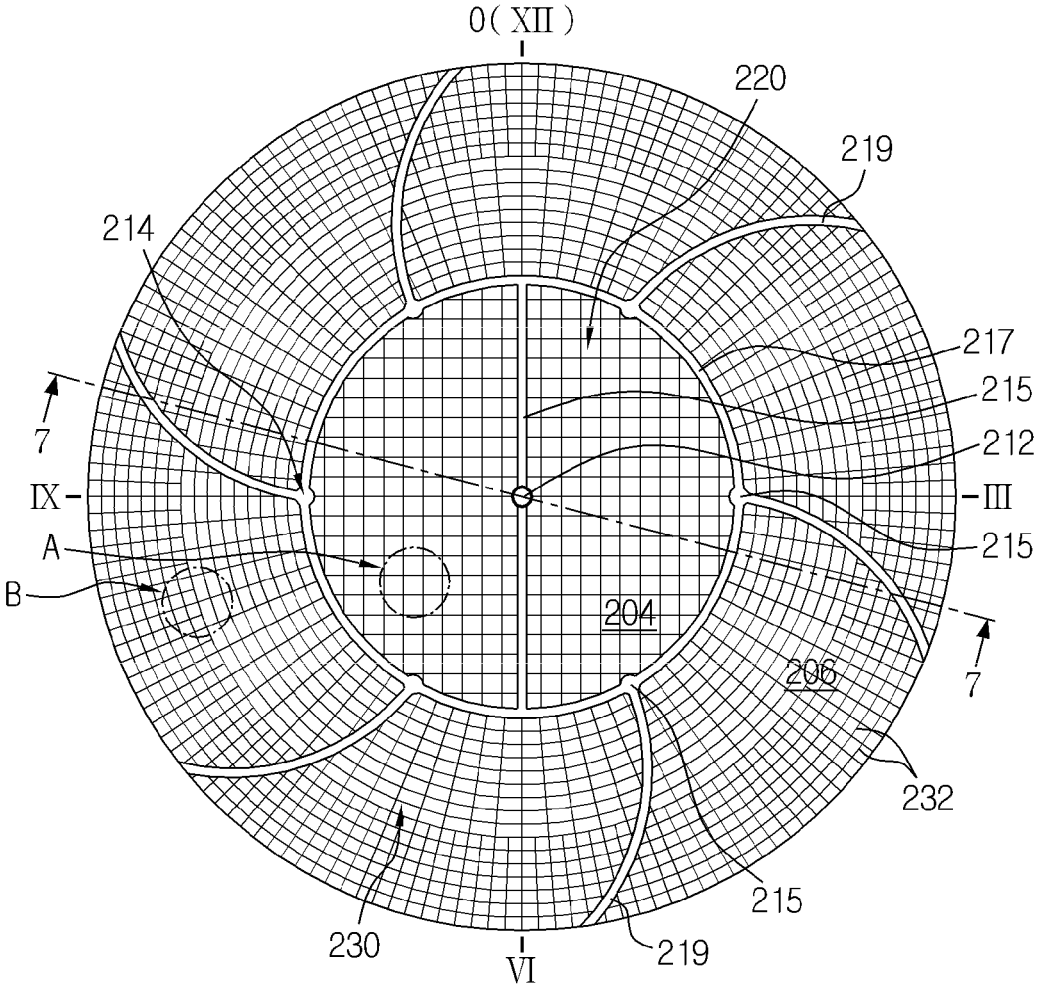
FIG. 4 is a plane view showing a polishing pad according to a preferred embodiment of the present disclosure.
Figure 5:
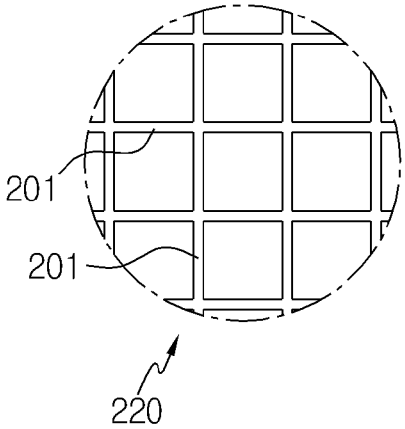
FIG. 5 is an enlarged view showing the portion "A" of FIG. 4.
Figure 6:
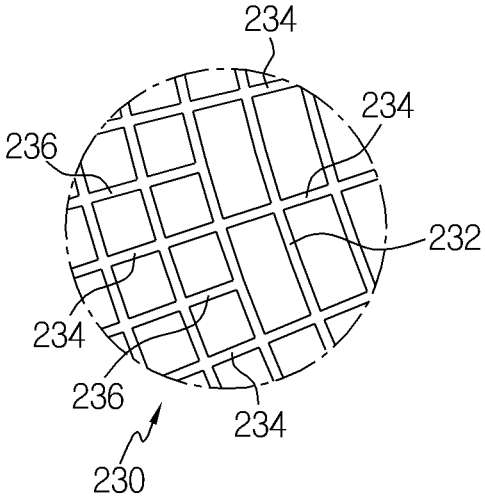
FIG. 6 is an enlarged view showing the portion "B" of FIG. 4.
Figure 7:
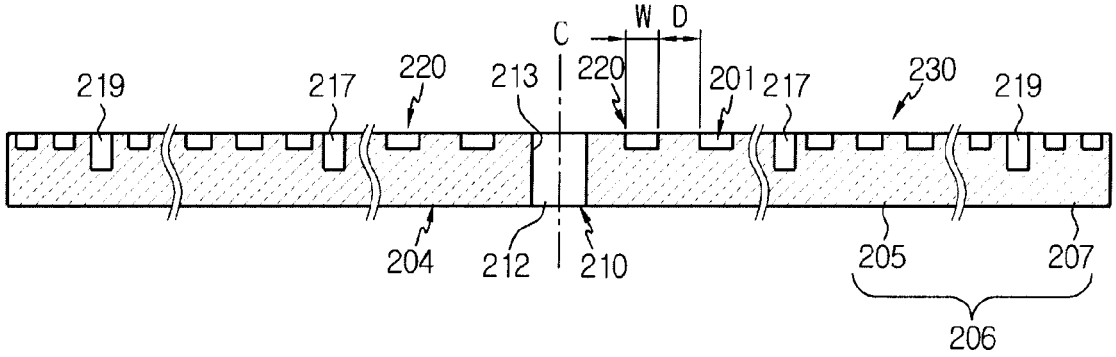
FIG. 7 is a cross-sectional view taken along the line 7-7 of FIG. 4.

FIG. 4 is a plane view showing a polishing pad according to a preferred embodiment of the present disclosure, FIG. 5 is an enlarged view showing the portion "A" of FIG. 4, FIG. 6 is an enlarged view showing the portion "B" of FIG. 4, and FIG. 7 is a cross-sectional view taken along the line 7-7 of FIG. 4.

Referring to FIGS. 4 to 7, the polishing pad 200 has a polishing surface 202 installed at the lower end of the upper unit 120 of the polishing system 100 of FIG. 3 and contactable with the sheet glass G, and the polishing pad 200 has a disk structure whose diameter is about 200 mm. In addition, the polishing pad 200 has two kinds of predetermined channel patterns, namely a first channel pattern 220 and a second channel pattern 230, so that a polishing liquid supplied from a polishing liquid supplier 210 formed through the polishing pad 200 may move on the polishing surface 202.

As shown in FIG. 7, each channel 201 has a width W of about 1 to 30 mm, and an interval D between neighboring channels 201 is about 10 to 100 mm.

In this embodiment, the polishing pad 200 includes a first region 204 containing the center C and a second region 206 divided to surround the first region. The first channel pattern 220 is formed in the first region 204, and the second channel pattern 230 is formed in the second region 206. In addition, the second region 206 includes an inner region 205 disposed adjacent to the first region 204 and an outer region 207 extending from the outer side of the inner region 205 to the outermost side of the polishing pad 200.

Referring to FIG. 5, the first channel pattern 220 has a conventional straight lattice pattern. In other words, the first channel pattern 220 is formed so that the channels 201 are substantially orthogonal to each other, similar to the conventional polishing pad 1.

Referring to FIG. 6, the second channel pattern 230 includes a plurality of circular channels 232 concentrically arranged from the center C and spaced apart from each other by a predetermined interval and a plurality of radial channels 234 extending radially from the center C to intersect the circular channels 232. Each radial channel 234 is provided to be in agreement with a centrifugal direction of the polishing pad 200 and is disposed in a straight form. However, as an alternative embodiment, the radial channel 234 may also be configured with a non-straight form, as apparent to those skilled in the art. In the second channel pattern 230, the pattern of channels formed in the outer region 207 is denser than the pattern of channels formed in the inner region 205. As an alternative embodiment, channels of the inner region 205 may be disposed more densely than channels of the outer region. The second channel pattern 230 further includes a second radial channel 236 formed between neighboring radial channels 234 in the outer region 207. The second radial channel 236 allows the radial channels 234 to be arranged more densely. As an alternative embodiment, the second radial channel 236 may have a curved form, without being limited to a straight form. Meanwhile, since the second channel pattern 230 is more influenced by a centrifugal force of the polishing pad 200, the second channel pattern 230 is preferably configured with a non-straight form (for example, a radial form, a curved form, a secondary curve or the like), and its direction may be identical to or opposite to the rotating direction of the polishing pad 200.

In a preferred embodiment of the present disclosure, the polishing liquid supplier 210 provided at the polishing pad 200 includes a first supplier 212 for supplying a polishing liquid to the first region 204 and a second supplier 214 for supplying a polishing liquid to the second region 206. The polishing liquid supplier 210 preferably has a width of 10 to 20 mm.

The first supplier 212 includes a first hole 213 formed through the polishing pad 200 to be in agreement with the center C and a straight supply path 215 disposed across the first region 204 to communicate with the first hole 213 and the second supplier 214 on the polishing surface.

The second supplier 214 includes a plurality of second holes 215 formed through the second supplier 214 on a border line of the first region 204 and the second region 206, a circular supply path 217 provided on the border line to communicate with the second holes 215, and a curved radial supply path 219 formed to curve outwards with a radial shape from each second hole 215. The circular supply path 217 also plays a role of separating and dividing the first region 204 and the second region 206 from each other. For this, the width of the circular supply path 217 may be greater than widths of other suppliers 210.

The polishing pad 200 configured as above may reduce the flow or flux deviation of the polishing liquid since the radial channel pattern is formed in a direction identical to the direction of the centrifugal force generated by the rotation of the polishing pad 200.

Figure 8:
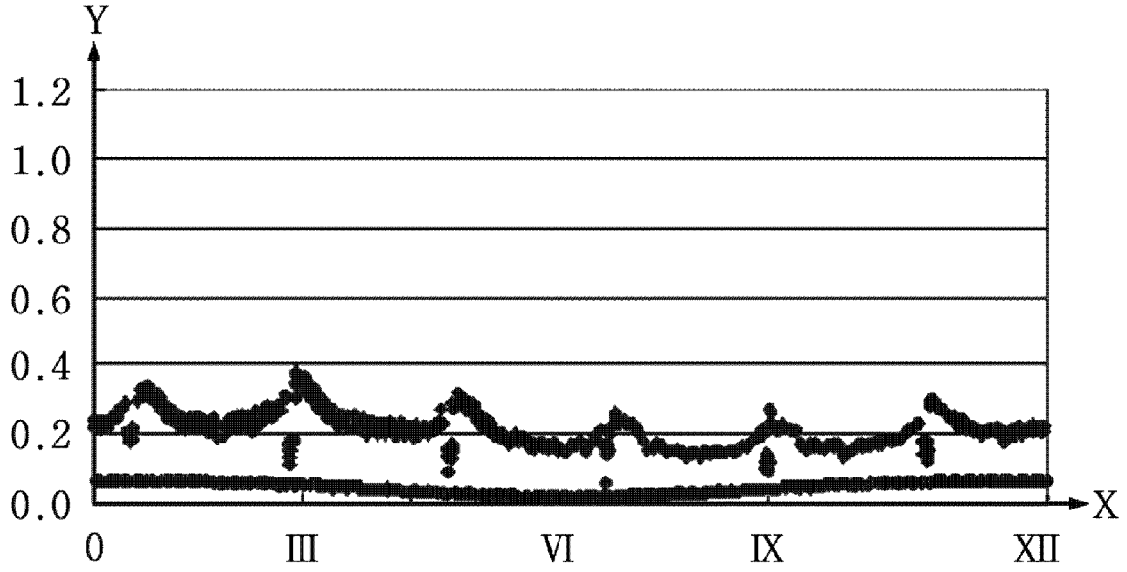
FIG. 8 is a graph showing a measurement result of a flow rate deviation of a polishing liquid, which is measured at the polishing pad according to a preferred embodiment of the present disclosure, shown in FIG. 4.

FIG. 8 is a graph showing a measurement result of a flow rate deviation of a polishing liquid, which is measured at the polishing pad according to a preferred embodiment of the present disclosure, shown in FIG. 4. Here, the X axis of the graph represents an arbitrary location of the polishing pad 200, which means a direction expressed by the Roman alphabet in FIG. 8, and the Y axis represents a flow rate ($kg/m^2s$) of the polishing liquid.

Referring to FIG. 5, in the polishing pad 200 according to a preferred embodiment of the present disclosure, the deviation of a flow rate is small over the entire area thereof. In other words, while the range of a speed deviation of a polishing liquid was 0.1 m/s to 0.6 m/s in a case where a conventional polishing pad was used, if the polishing pad 200 according to the present disclosure is used, the range of a speed deviation is 0.15 m/s to 0.4 m/s, which is reduced than the conventional one. As described above, as the speed deviation of the polishing liquid is reduced, an unnecessary hydroplaning phenomenon may be prevented, and the polishing flatness of the sheet glass G may be ensured. In addition, since the polishing work may be uniformly performed near the edge of the polishing pad 200, a wide processing range is ensured.

The above description and accompanying drawings illustrate preferred embodiments of the present invention, and it should be understood that various additions, modifications, combinations and/or substitutes can be made without departing from the spirit and scope of the invention, as defined in the appended claims. In particular, it would be understood by those of ordinary skill in the art that the present invention may be implemented with different specific shapes, structures, arrangements, or ratios by using other elements, materials, and components within the scope of the invention. It would also be understood by those of ordinary skill in the art that the present invention can be used with many modifications of structures, arrangements, ratios, materials, and components to be particularly suitable for specific environments or operation conditions within the principle of the invention. Also, the features described in the specification can be used solely or in combination with other features. For example, any features described in relation with one embodiment may be used together with and/or as a substitute for other features described in another embodiment. Thus, the disclosed embodiments should be construed not to limit the invention but to illustrate the invention in all aspects, and the scope of the invention is defined in the appended claims and not limited by the detailed description.

Any person having ordinary skill in the art would understand that various changes and modifications can be made to the invention within the scope of the invention. Some of these changes and modifications have already been discussed above, and other changes will be apparent to those of ordinary skill in the art.

What is claimed is:

1. A polishing pad of a polishing system, which is mountable to a polishing plate and has a predetermined channel pattern so as to allow a polishing liquid supplied from a polishing liquid supplier to move on a polishing surface, wherein the channel pattern has at least two kinds of patterns, wherein the polishing liquid supplier includes:

a first supplier for supplying the polishing liquid to a first region; and a second supplier for supplying the polishing liquid to a second region, and wherein the first supplier includes:

a first hole formed through the first supplier to be in agreement with the center; and a straight supply path disposed across the first region to communicate with the first hole and the second supplier.

2. The polishing pad of a polishing system according to claim 1, wherein the polishing pattern includes:

a first channel pattern formed in a first region containing the center of the polishing pad; and a second channel pattern formed in a second region divided to surround the first region from the center toward the outside.

3. The polishing pad of a polishing system according to claim 2, wherein the second channel pattern includes:

at least two circular channels concentrically arranged from the center and spaced apart from each other by a predetermined interval; and a plurality of radial channels extending radially from the center to intersect the circular channels.

4. The polishing pad of a polishing system according to claim 3, wherein each radial channel is provided to be in agreement with a centrifugal direction of the polishing pad.

5. The polishing pad of a polishing system according to claim 2, wherein the second region includes an inner region disposed adjacent to the first region and an outer region disposed at an outer side of the inner region, and wherein, in the second channel pattern, channels of the outer region are disposed more densely than channels of the inner region.

6. The polishing pad of a polishing system according to claim 5, wherein the second channel pattern further includes a second radial channel formed between neighboring radial channels in the outer region.

7. A polishing pad of a polishing system, which is mountable to a polishing plate and has a predetermined channel pattern so as to allow a polishing liquid supplied from a polishing liquid supplier to move on a polishing surface, wherein the channel pattern has at least two kinds of patterns, wherein the polishing liquid supplier includes:

a first supplier for supplying the polishing liquid to a first region; and a second supplier for supplying the polishing liquid to a second region, and wherein the second supplier includes:

a plurality of second holes formed through the second supplier on a border line of the first region and the second region;

a circular supply path provided on the border line to communicate with the second holes; and a curved radial supply path formed to curve outwards with a radial shape from each second hole.

8. The polishing pad of a polishing system according to claim 1, wherein the polishing pad is circular.

9. The polishing pad of a polishing system according to claim 2, wherein the first channel pattern includes a plurality of lattice-type channels substantially orthogonal to each other.

10. The polishing pad of a polishing system according to claim 1, wherein the channel has a width of about 1 to 30 mm, and an interval between neighboring channels is about 10 to 100 mm.

* * * * *